US010317811B2

(12) United States Patent
Tomomizu et al.

(10) Patent No.: US 10,317,811 B2
(45) Date of Patent: Jun. 11, 2019

(54) CHARGING MEMBER, METHOD FOR PRODUCING SAME, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Yuya Tomomizu, Yokohama (JP); Takumi Furukawa, Susono (JP); Hiroaki Watanabe, Odawara (JP); Kenya Terada, Suntou-gun (JP); Kazuhiro Gesho, Kariya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/703,148

(22) Filed: Sep. 13, 2017

(65) Prior Publication Data

US 2018/0101107 A1 Apr. 12, 2018

(30) Foreign Application Priority Data

Oct. 7, 2016 (JP) ..... 2016-199272

(51) Int. Cl.
*G03G 15/02* (2006.01)

(52) U.S. Cl.
CPC ..... *G03G 15/0233* (2013.01)

(58) Field of Classification Search
None
See application file for complete search history.

(56) References Cited

U.S. PATENT DOCUMENTS

| | | | |
|---|---|---|---|
| 5,198,685 | A | 3/1993 | Kitani et al. |
| 7,693,457 | B2 | 4/2010 | Kuruma et al. |
| 7,962,068 | B2 | 6/2011 | Kuroda et al. |
| 8,440,307 | B2 | 5/2013 | Nose et al. |
| 8,445,113 | B2 | 5/2013 | Furukawa et al. |
| 8,469,867 | B2 | 6/2013 | Kuroda et al. |
| 8,481,167 | B2 | 7/2013 | Watanabe et al. |
| 8,491,994 | B2 | 7/2013 | Harada et al. |
| 8,501,312 | B2 | 8/2013 | Watanabe et al. |

(Continued)

FOREIGN PATENT DOCUMENTS

| | | |
|---|---|---|
| EP | 2 730 977 | 5/2014 |
| EP | 3 026 495 | 6/2016 |

(Continued)

*Primary Examiner* — Victor Verbitsky
(74) *Attorney, Agent, or Firm* — Venable LLP

(57) ABSTRACT

It is intended to provide a charging member capable of maintaining high charging performance even when used over a long period. The charging member has an electroconductive support and an electroconductive elastic layer as a surface layer, wherein the electroconductive elastic layer has a roughened surface, and the electroconductive elastic layer has an average Martens' hardness Mc of 2 N/mm$^2$ or larger and 20 N/mm$^2$ or smaller measured with an indentation strength of 0.04 mN at a core surface defined according to a three dimensional surface texture standard (ISO 25178-2:2012), and has an average viscosity Vc of $70\times10^{-3}$ V or smaller measured in a square of 2 μm long×2 μm wide field of view under a scanning probe microscope.

2 Claims, 4 Drawing Sheets

(56) References Cited

U.S. PATENT DOCUMENTS

| | | | | |
|---|---|---|---|---|
| 8,501,325 | B2 | 8/2013 | Tomomizu et al. | |
| 8,503,911 | B2 | 8/2013 | Suzumura et al. | |
| 8,526,857 | B2 | 9/2013 | Tomomizu et al. | |
| 8,532,535 | B2 | 9/2013 | Nose et al. | |
| 8,538,298 | B2 | 9/2013 | Harada et al. | |
| 8,622,881 | B1 | 1/2014 | Harada et al. | |
| 8,685,601 | B2 | 4/2014 | Nose et al. | |
| 8,712,291 | B2 | 4/2014 | Suzuki | |
| 8,750,762 | B2 | 6/2014 | Harada et al. | |
| 8,755,714 | B2 | 6/2014 | Nagamine et al. | |
| 8,923,732 | B2 | 12/2014 | Harada et al. | |
| 8,991,053 | B2 | 3/2015 | Watanabe et al. | |
| 9,360,833 | B2 | 6/2016 | Terada et al. | |
| 9,372,428 | B2 | 6/2016 | Kuroda et al. | |
| 9,372,429 | B2 | 6/2016 | Watanabe et al. | |
| 2009/0087212 | A1* | 4/2009 | Ogura | G03G 15/0225 399/100 |
| 2012/0076535 | A1 | 3/2012 | Nagamine et al. | |
| 2013/0004206 | A1 | 1/2013 | Kuroda et al. | |
| 2013/0034369 | A1 | 2/2013 | Masu et al. | |
| 2013/0064571 | A1 | 3/2013 | Kodama et al. | |
| 2013/0272747 | A1* | 10/2013 | Watanabe | B05D 5/00 399/168 |
| 2013/0302064 | A1 | 11/2013 | Furukawa et al. | |
| 2014/0219681 | A1* | 8/2014 | Harada | G03G 15/0233 399/176 |
| 2015/0198904 | A1* | 7/2015 | Kikuchi | G03G 15/0233 492/18 |
| 2016/0154335 | A1 | 6/2016 | Yamauchi et al. | |
| 2017/0115590 | A1 | 4/2017 | Furukawa et al. | |
| 2017/0115591 | A1 | 4/2017 | Terada et al. | |

FOREIGN PATENT DOCUMENTS

| | | | |
|---|---|---|---|
| JP | H07-134467 | A | 5/1995 |
| JP | 2004-109528 | A | 4/2004 |
| JP | 2007-163849 | A | 6/2007 |
| JP | 2008-256908 | A | 10/2008 |
| JP | 2013-205674 | A | 10/2013 |

* cited by examiner

CHARGING MEMBER, METHOD FOR PRODUCING SAME, PROCESS CARTRIDGE AND ELECTROPHOTOGRAPHIC IMAGE FORMING APPARATUS

BACKGROUND OF THE INVENTION

Field of the Invention

The present invention relates to a charging member for use in electrophotographic image forming apparatuses, etc., a process cartridge and an electrophotographic image forming apparatus.

Description of the Related Art

In an electrophotographic image forming apparatus such as a laser beam printer, a plurality of components such as a photosensitive member, a charging member, a developing member and a cleaning member may be integrally installed to prepare a process cartridge, which may be detachably attachable to a main body of the apparatus. In recent years, longer-life process cartridges and decrease in the number of members have been demanded for reducing printing cost or reducing environmental load. For satisfying these demands, it is particularly important to prevent image unevenness caused by the adhesion of toner, external additives or the like to the charging member.

From this viewpoint, Japanese Patent Application Laid-Open No. 2013-205674 proposes an approach of suppressing the adhesion of toner, external additives or the like to the surface of a charging member by smoothening the surface shape of the charging member and thereby decreasing the friction between the charging member and a photosensitive member. Japanese Patent Application Laid-Open No. H07-134467 proposes an approach of allowing a surface layer of a charging member to contain a fluorine resin. Japanese Patent Application Laid-Open No. 2004-109528 proposes an approach of suppressing the adhesion of toner, external additives or the like to the surface of a charging member by forming a surface layer of the charging member with a hybrid resin containing a fluorine component and a polysiloxane oligomer in an acrylic skeleton.

However, the method which involves smoothening the surface shape of a charging member or allowing a surface layer to contain a fluorine component has a difficulty in completely preventing the adhesion of toner, external additives or the like to the surface of the charging member. Toner, external additives or the like may gradually accumulate on the surface of the charging member with increase in the number of prints so that the surface potential of the photosensitive member varies and is thereby destabilized, resulting in image unevenness. Thus, there is a demand for a charging member that uniformly charges the surface of a photosensitive member even when toner, external additives or the like accumulate on the surface of the charging member.

SUMMARY OF THE INVENTION

One aspect of the present invention is directed to providing a charging member capable of maintaining high charging performance even when used over a long period, and a method for producing the same.

Further, another aspect of the present invention is directed to providing a process cartridge and an electrophotographic image forming apparatus capable of stably forming a high quality electrophotographic image.

According to one aspect of the present invention, there is provided a charging member having an electroconductive support and an electroconductive elastic layer as a surface layer, wherein the electroconductive elastic layer has a roughened surface, and the electroconductive elastic layer has an average Martens' hardness Mc of 2 $N/mm^2$ or larger and 20 $N/mm^2$ or smaller measured with an indentation strength of 0.04 mN at a core surface defined according to a three dimensional surface texture standard (ISO 25178-2: 2012), and has an average viscosity Vc of $70\times10^{-3}$ V or smaller measured at this core surface in a square of 2 μm long×2 μm wide field of view under a scanning probe microscope.

According to one aspect of the present invention, there is provided a method for producing the aforementioned charging member, the method including the following steps 1 to 3:

step 1: preparing an unvulcanized rubber composition including a rubber composition and an insulating particle;

step 2: supplying the electroconductive support and the unvulcanized rubber composition to a crosshead extrusion molding machine and taking up the resultant under conditions involving a take-up rate exceeding 100% to obtain an unvulcanized rubber roller having a layer of the unvulcanized rubber composition on the periphery of the electroconductive support; and step 3: vulcanizing the layer of the unvulcanized rubber composition in air, followed by surface treatment to obtain the electroconductive elastic layer.

According to one aspect of the present invention, there is provided a process cartridge detachably attachable to a main body of an electrophotographic image forming apparatus, the process cartridge including an electrophotographic photosensitive member and a charging member which charges the electrophotographic photosensitive member, the charging member being the aforementioned charging member.

According to one aspect of the present invention, there is provided an electrophotographic image forming apparatus including an electrophotographic photosensitive member and a charging member which charges the electrophotographic photosensitive member, the charging member being the aforementioned charging member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 3:
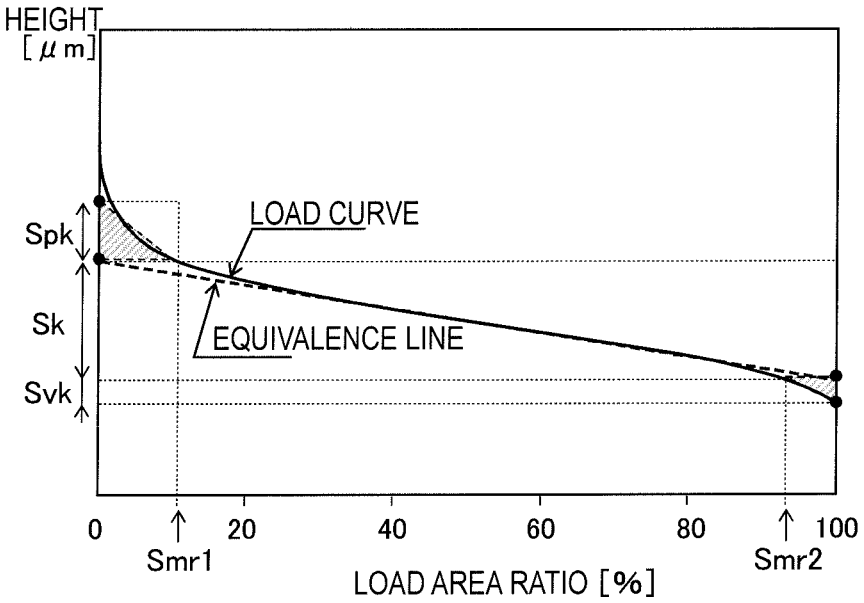
FIG. 3 is a diagram illustrating Sk, Spk and Svk defined according to the three dimensional surface texture standard.

In the charging member according to one aspect of the present invention, the terms "core surface", "convex part", "Spk", "Svk" and "Sk" are defined according to three dimensional surface texture standard (ISO 25178-2:2012). Each of these terms will be described with reference to FIG. 3. A curve indicating heights at which the area ratio of a region having a face and a given height or larger becomes 0% to 100% is referred to as a load curve.

A most mildly sloped line (equivalence line) is drawn from the load curve to thereby determine a height at the load area ratio of 0% and a height at the load area ratio of 100% in the equivalence line.

The core surface is a part included in the range of heights at the load area ratios of 0% to 100% in the equivalence line. The convex part is a part protruding upward from the core surface and is a part corresponding to the range of the load area ratio of 0% to Smr1% in the load curve.

Spk, Svk and Sk are calculated from the load curve and the two heights (the height at the load area ratio of 0% and the height at the load area ratio of 100% in the equivalence line). Sk is a value determined by subtracting the smallest height from the largest height of the core surface and represents the level difference of the core surface. Spk represents a convex part height and is calculated by averaging the heights of a face higher than Sk. Svk represents a concave part height and is calculated by averaging the heights of a face lower than Sk. Smr1 is a load area ratio that separates between the convex part and the core surface.

The charging member includes an electroconductive support and an electroconductive elastic layer which is a surface layer formed on the electroconductive support. The electroconductive elastic layer is a surface layer that has a roughened surface. The surface of the surface layer has an average Martens' hardness Mc of 2 $N/mm^2$ or larger and 20 $N/mm^2$ or smaller measured with an indentation strength of 0.04 mN at a core surface defined according to the three dimensional surface texture standard, and has an average viscosity Vc of $70\times10^{-3}$ V or smaller measured at this core surface in a 4 μm square (2 μm long×2 μm wide) field of view under a scanning probe microscope.

Figure 1:
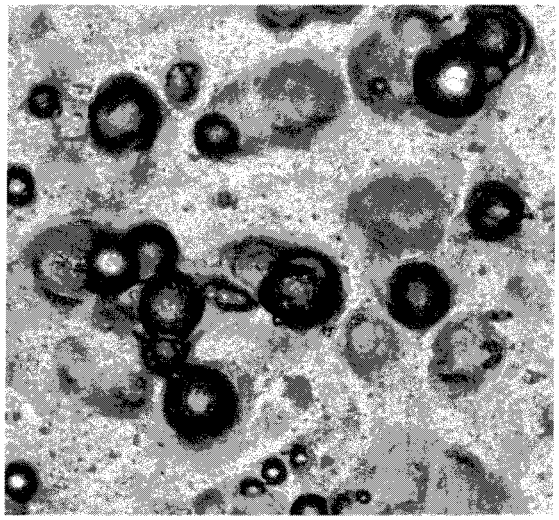
FIG. 1 is a diagram (photograph) illustrating one example of the surface of the charging member according to the present invention.
Figure 2:
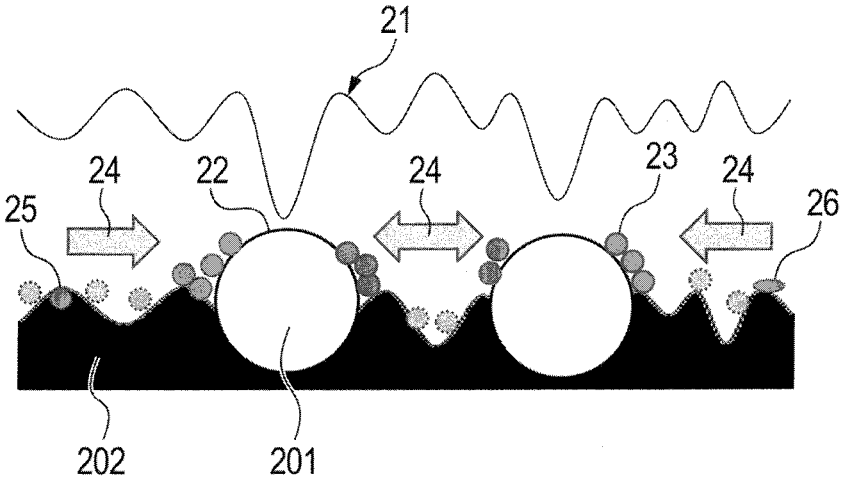
FIG. 2 is a schematic diagram illustrating the effects of the present invention on the surface of the charging member according to the present invention and its neighborhood.

The present inventors have hypothesized the following mechanism under which the charging member produces uniform charging by stabilizing the surface potential of a photosensitive member even when toner, external additives or the like adhere and accumulate on the surface of the charging member. First, FIG. 1 is a diagram (photograph) illustrating one example of the surface of the charging member of the present invention. FIG. 2 is a schematic diagram illustrating the effects of the present invention on the surface of the charging member of the present invention and its neighborhood.

When the charging member has a roughened surface, a fine potential gradient of several μm to dozens of μm wide, which does not appear on actual images, occurs on the surface of the photosensitive member contacted with the charging member. In FIG. 2, the potential gradient is schematically represented by curve 21. The potential gradient becomes large in protrusion 22 and its neighborhood on the surface of the charging member. In this context, the protrusion 22 is constituted by, for example, insulating particle 201. Toner 23 adherent to the surface of the charging member is charged with an electric charge opposite to that of a charging bias by electric discharge upon charging of the photosensitive member. When the photosensitive member and the charging member come in contact with each other in this state, the toner 23 on the surface of the charging member moves to the protrusion 22 on the surface of the charging member, which is a site with a large surface potential gradient of the photosensitive member, because the toner 23 is charged with an electric charge opposite to that of the photosensitive member. In this respect, the toner, together with external additives, moves in the directions indicated by the arrows in FIG. 2. Therefore, the toner and the external additives adherent to the surface of the charging member gather to the protrusion 22 on the surface of the charging member. As a result, the variation in the surface potential of the photosensitive member can be confined to surface potential variation at and near the protrusion, i.e., surface potential variation at a local site from several μm to dozens of μm wide, which does not appear on actual images. Therefore, even when toner, external additives or the like adhere and accumulate on the surface of the charging member, the average surface potential of the photosensitive member is considered to be stable by the movement of the toner.

For allowing the toner on the surface of the charging member to move, the average Martens' hardness Mc at the core surface needs to be 2 N/mm2 or larger and 20 N/mm2 or smaller, and the average viscosity Vc at the core surface needs to be $70\times10^{-3}$V or smaller.

If the average Martens' hardness Mc is less than 2 $N/mm^2$, a toner particle may be buried in electroconductive elastic layer 202 from the surface of the charging member due to the too soft surface of the charging member (see reference numeral 25 of FIG. 2). If the average Martens' hardness Mc exceeds 20 $N/mm^2$, a toner particle may be cracked due to the hard surface of the charging member so that such a cracked toner particle 26 adheres to the surface of the charging member. If the average viscosity Vc at the core surface exceeds $70\times10^{-3}$V, toner may be fixed to the surface of the charging member due to the large adhesion force between the surface of the charging member and the toner.

The electroconductive elastic layer which is a surface layer in the charging member can contain a vulcanized product of a rubber composition containing a polymer having a butadiene skeleton. The Martens' hardness of the core surface specified in the charging member is the hardness of a part of dozens of nm to hundreds of nm deep from the surface of the charging member. The viscosity of the core surface measured under a scanning probe microscope is the viscosity of a part of several nm deep from the surface. A double bond of the rubber composition having a butadiene skeleton remains easily even after vulcanization. Only a site of several nm from the surface can be oxidatively cured. Therefore, the charging member having an average Martens' hardness Mc and an average viscosity Vc within the ranges described above in the topmost layer of the surface of the charging member can be more easily obtained.

The roughened surface of the charging member can have Spk of 3 μm or larger and 10 μm or smaller and Sk of 15 μm or smaller. When Spk is 3 μm or larger, the surface potential gradient of the photosensitive member necessary for the movement of toner that has adhered and accumulated on the surface of the charging member is sufficiently created. Provided that Spk is 10 μm or smaller, image unevenness resulting from a large surface potential gradient of the photosensitive member can be suppressed. Provided that Sk is 15 μm or smaller, the distance between the photosensitive member and the toner adherent to the charging member is not too large. Thus, reduction in effects brought about by the movement of toner by the surface potential gradient of the photosensitive member can be suppressed, and image unevenness resulting from a large surface potential gradient of the photosensitive member can be suppressed. Therefore, Spk can be 3 μm or larger and 10 μm or smaller, and Sk can be 15 μm or smaller.

The roughened surface can have Svk of 6 μm or smaller and Sk of 15 μm or smaller. Provided that Svk is 6 μm or smaller, the insufficient charging of the concave part is prevented. Thus, image unevenness can be suppressed. Provided that Sk is 15 μm or smaller, the distance between the photosensitive member and the toner adherent to the charging member is not too large. Thus, reduction in effects brought about by the movement of toner by the surface potential gradient of the photosensitive member can be suppressed, and a surface potential gradient of the photosensitive member at a level appearing on images can be suppressed. As a result, image unevenness can be suppressed. Therefore, Svk can be 6 μm or smaller, and Sk can be 15 μm or smaller.

The surface of the surface layer of the charging member can be roughened by an exposed insulating particle. This is because by the roughening by the exposed insulating particle, strong electric discharge ascribable to the charge up of the peak part of the exposed insulating particle occurs so that a sharp and fine surface potential gradient of the photosensitive member with a large potential difference can be created; thus, the movement of toner adherent to the surface of the charging member can be promoted more effectively. The phrase "exposed on the surface layer" means that the insulating particle is exposed on at least the apex of a peak part closer to the photosensitive member among peak parts formed by a plurality of particles present on the surface of the charging member.

The average Martens' hardness Mp measured with an indentation strength of 0.04 mN at the convex part of the roughened surface can be smaller than the average Martens' hardness Mc measured with an indentation strength of 0.04 mN at the core surface. The convex part may apply larger stress to adherent toner than the core surface upon contact between the photosensitive member and the charging member. Therefore, the lower hardness of the convex part than that of the core surface can promote the elastic deformation of the convex part and more effectively suppress fixation caused by the degradation of toner adherent to the surface of the charging member. This elastic deformation of the convex part allows the distance at the contact part between the toner on the surface of the charging member and the photosensitive member to approach a distance susceptible to the surface potential gradient of the photosensitive member, and can thereby further promote the movement of the toner adherent to the charging member.

The insulating particle can be a balloon-shaped particle of an insulating resin. This is because by the roughening by the balloon-shaped particle exposed on the surface layer, strong electric discharge ascribable to the charge up of the protrusion can be effectively caused, as compared with a solid particle, owing to the high insulating properties of airspace within the balloon-shaped particle. This is also because, since elastic deformation occurs easily, as compared with a solid particle, owing to the influence of the airspace within the particle, the distance at the contact part between the toner on the surface of the charging member and the photosensitive member is allowed to approach a distance susceptible to the surface potential gradient of the photosensitive member; thus, the movement of the toner adherent to the charging member can be further promoted.

Hereinafter, exemplary embodiments of the present invention will be described in detail.

<Charging Member>

Figure 4:
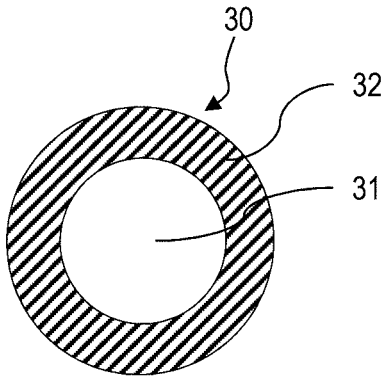
FIG. 4 is a diagram illustrating a configuration example of the charging roller according to the present invention.

FIG. 4 illustrates a block diagram of a charging roller as one example of the charging member. The charging roller includes electroconductive support 31 and surface layer (electroconductive elastic layer) 32 formed on the electroconductive support. Hereinafter, each component constituting the charging member will be described in order.

[Rubber Composition Having Butadiene Skeleton]

The charging member has, for example, an electroconductive elastic body containing a vulcanized product of a rubber composition containing a polymer having a butadiene skeleton, as the surface layer. The electroconductive elastic body can have a volume resistivity of $10^3$ Ωcm or more and $10^9$ Ωcm or less. The electroconductive elastic body can also be referred to as a vulcanized product of a rubber composition containing raw rubber, an electroconductive agent and a cross linking agent. A rubber composition containing butadiene rubber, isoprene rubber, chloroprene rubber, acrylonitrile-butadiene rubber, styrene-butadiene rubber, styrene-butadiene-styrene rubber or the like is suitably used as the polymer having a butadiene skeleton.

Mechanisms that confer electroconductivity are broadly divided into two mechanisms: an ion conductive mechanism and an electron conductive mechanism. The rubber composition with the ion conductive mechanism generally includes polar rubber typified by chloroprene rubber or acrylonitrile-butadiene rubber, and an ion conductive agent. This ion conductive agent is an ion conductive agent that is ionized in the polar rubber, resulting in the high mobility of the resulting ion. The rubber composition with the electron conductive mechanism is generally rubber containing carbon black, carbon fiber, graphite, a fine metal powder, a metal oxide or the like dispersed as an electroconductive particle. The rubber composition with the electron conductive mechanism has advantages such as small temperature and humidity dependence of electric resistance, a little bleed or bloom, and inexpensiveness, as compared with the rubber composition with the ion conductive mechanism. Therefore, the rubber composition with the electron conductive mechanism can be used.

Examples of the electroconductive particle include: electroconductive carbon such as Ketjen black EC and acetylene black; carbon for rubber, such as SAF, ISAF, HAF, FEF, GPF, SRF, FT and MT; metals and metal oxides, such as tin oxide, titanium oxide, zinc oxide, copper and silver; and oxidized carbon for color (ink), pyrolytic carbon, natural graphite and artificial graphite. The electroconductive particle can form no large protrusion on the surface of the electroconductive elastic layer, and a particle having an average particle size of 10 nm to 300 nm can be used.

The amount of the electroconductive particle used can be appropriately selected according to the types of the raw rubber, the electroconductive particle and other added agents such that the rubber composition attains the desired electric resistance value. The electroconductive particle can be used at, for example, 0.5 parts by mass or larger and 100 parts by mass or smaller, preferably 2 parts by mass or larger and 60 parts by mass or smaller, with respect to 100 parts by mass of the raw rubber.

The rubber composition can also contain other electroconductive agents, a filler, a processing aid, an antiaging agent, a cross linking aid, a cross linking accelerator, a cross linking acceleration aid, a cross linking retarder, a dispersant and the like.

The surface layer may be multilayered. The surface layer can be a single layer from the viewpoint of cost reduction by a simple production process, and reduction in environmental load. In short, the surface layer can be a single layer and be the sole elastic layer. In this case, the thickness of the surface layer can be in the range of 0.8 mm or larger and 4.0 mm or smaller, particularly, 1.2 mm or larger and 3.0 mm or smaller, in order to secure a nip width for the photosensitive member.

[Martens' Hardness and Viscosity of Surface Layer]

In the charging member, the surface physical properties of the surface layer (electroconductive elastic layer) are an average Martens' hardness Mc of 2 $N/mm^2$ or larger and 20 $N/mm^2$ or smaller measured with an indentation strength of 0.04 mN at a core surface defined according to the three dimensional surface texture standard, and an average viscosity Vc of $70\times10^{-3}$V or smaller measured at this core surface in a square of 2 μm long×2 μm wide field of view under a scanning probe microscope. The measurement sites for each of the Martens' hardness and the viscosity are a total of 10 sites involving one arbitrary site in each region of the charging member equally divided into 10 parts in the longitudinal direction.

The Martens' hardness of the core surface defined according to the three dimensional surface texture standard can be determined by identifying the core surface under a confocal microscope (trade name: Optelics Hybrid, manufactured by Lasertec Corp.), followed by measurement using a microhardness measurement apparatus (trade name: PICODENTOR HM500®, manufactured by FISCHER INSTRUMENTS K.K.) and an attached microscope. The whole height image observed with a 20× objective lens at the number of pixels of 1024 and a height resolution of 0.1 μm is subjected to curved surface correction for three dimensional measurement. The height image is binarized using the measured value of Sk to thereby identify the core surface. The method for measuring the value of Sk will be mentioned later. The Martens' hardness can be measured under conditions involving an indentation rate of the following expression (1) by using the microscope attached to the microhardness measurement apparatus in an environment involving a temperature of 25° C. and a relative humidity of 50%, and contacting a quadrangular pyramid-shaped diamond indenter with the core surface identified under the white light confocal microscope.

$$dF/dt=0.1 \text{ mN}/10 \text{ s} \qquad \text{Expression (1)}$$

In the expression (1), F represents strength, and t represents time.

Hardness upon indentation of the indenter with strength of 0.04 mN is extracted from the measurement results, and the values measured at the 10 sites are averaged to obtain the average Martens' hardness Mc of the core surface.

The identification of the convex part and the measurement of the average Martens' hardness of the convex part can be performed in the same way as in the case of the core surface. This Martens' hardness measurement method is referred to as "evaluation 1" in Examples.

The viscosity of the core surface to be measured in a square of 2 μm long×2 μm wide field of view under a scanning probe microscope can be measured under a scanning probe microscope (trade name: MFP-3D Origin®, manufactured by OXFORD INSTRUMENTS K.K.). The measurement sites for the viscosity are a total of 10 sites involving one arbitrary site in each region of the charging member equally divided into 10 parts in the longitudinal direction, as in the Martens' hardness measurement. The viscosity is measured using viscosity-elasticity mapping as a measurement mode, AC160FS (manufactured by Olympus Corp.) as a probe and a spring constant of 38.7 N/m for the probe under measurement conditions involving a scan rate of 2 Hzm, a scan range of 2 μm, a free amplitude of 2 V and a setpoint of 1 V. The values measured at the 10 sites are averaged to obtain the average viscosity Vc. This viscosity measurement method is referred to as "evaluation 2" in Examples.

[Roughening]

The charging member has a roughened surface. In the present invention, the roughening means that the sum of the Spk, Sk and Svk values according to the three dimensional surface texture standard is 3 μm or larger. The Spk, Svk and Sk values can be measured under a confocal microscope (trade name: Optelics Hybrid, manufactured by Lasertec Corp.). These values can be calculated by subjecting the whole height image observed with a 20× objective lens at the number of pixels of 1024 and a height resolution of 0.1 μm to curved surface correction for three dimensional measurement. The method for calculating these Spk, Svk and Sk values is referred to as "evaluation 3" in Examples.

Examples of a unit for controlling the Spk, Sk and Svk values include a method of mixing a roughening particle into the electroconductive elastic layer, and rolling. Particularly, a control approach of adding a roughening particle into a rubber composition and optimizing extrusion molding conditions or vulcanization conditions can be used from the viewpoint of a convenient production method.

[Insulating Particle]

The roughening can be achieved by exposing an insulating particle on the surface of the charging member. The insulating particle can have a volume resistivity of $10^{10}$ Ωcm or more in terms of insulating properties. The volume resistivity of the insulating particle can be determined by pelletizing the insulating particle under pressure and measuring the volume resistivity of this pellet using a powder resistance measurement apparatus (trade name: powder resistance measurement system model MCP-PD51, manufactured by Mitsubishi Chemical Analytech Co., Ltd.). For the palletization, the particle to be assayed is placed in a cylindrical chamber of 20 mm in diameter in the powder resistance measurement apparatus. The filling amount is set such that the layer thickness of the pellet is 3 to 5 mm under pressure of 20 kN. The measurement is performed at an applied voltage of 90 V and a load of 4 kN in an environment involving a temperature of 23° C. and a relative humidity of 50%. The method for measuring this "volume resistivity of the insulating particle" is referred to as "evaluation B" in Examples.

Examples of the material for the insulating particle include, but are not particularly limited to, a particle made of at least one resin selected from the group consisting of phenol resin, silicone resin, polyacrylonitrile resin, polystyrene resin, polyurethane resin, nylon resin, polyethylene resin, polypropylene resin, acrylic resin and the like.

Examples of the shape of the insulating particle include, but are not particularly limited to, spherical, indefinite, bowl and balloon shapes. Particularly, a balloon-shaped particle can be used because the particle has high insulating properties owing to the presence of airspace within the particle and is capable of being elastically deformed by contact pressure. An expanded form of a thermally expandable microcapsule can be used as the balloon-shaped particle.

The thermally expandable microcapsule is a material that contains a core material inside a shell and becomes a balloon-shaped resin particle by expanding the core material by the application of heat.

In the case of using the thermally expandable microcapsule, a thermoplastic resin needs to be used as a shell material. Examples of the thermoplastic resin include acrylonitrile resin, vinyl chloride resin, vinylidene chloride resin, methacrylic acid resin, styrene resin, urethane resin, amide resin, methacrylonitrile resin, acrylic acid resin, acrylic acid ester resins and methacrylic acid ester resins. Among these resins, at least one thermoplastic resin selected from the group consisting of acrylonitrile resin, vinylidene chloride resin and methacrylonitrile resin which have low gas permeability and exhibit high rebound resilience can be used. These thermoplastic resins can be used alone or in combination of two or more thereof. Alternatively, monomers serving as starting materials for these thermoplastic resins may be copolymerized to prepare a copolymer.

The core material of the thermally expandable microcapsule can expand in the form of a gas at a temperature equal to or lower than the softening point of the thermoplastic resin. Examples thereof include: low boiling liquids such as propane, propylene, butene, normal butane, isobutane, normal pentane and isopentane; and high boiling liquids such as normal hexane, isohexane, normal heptane, normal octane, isooctane, normal decane and isodecane.

The thermally expandable microcapsule described above can be produced by a production method known in the art, i.e., a suspension polymerization, interfacial polymerization, interfacial settling or liquid drying method. Examples of the suspension polymerization method can include a method which involves mixing a polymerizable monomer, a material to be contained in the thermally expandable microcapsule and a polymerization initiator, and dispersing this mixture into an aqueous medium containing a surfactant or a dispersion stabilizer, followed by suspension polymerization. A compound having a reactive group that reacts with a functional group in the polymerizable monomer, or an organic filler can also be added thereto.

Examples of the polymerizable monomer can include: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride and vinyl acetate; acrylic acid esters (methyl acrylate, ethyl acrylate, n-butyl acrylate, isobutyl acrylate, t-butyl acrylate, isobornyl acrylate, cyclohexyl acrylate and benzyl acrylate); methacrylic acid esters (methyl methacrylate, ethyl methacrylate, n-butyl methacrylate, isobutyl methacrylate, t-butyl methacrylate, isobornyl methacrylate, cyclohexyl methacrylate and benzyl methacrylate); and styrene monomers, acrylamide, substituted acrylamide, methacrylamide, substituted methacrylamide, butadiene, ε-caprolactam, polyether and isocyanate. These polymerizable monomers can be used alone or in combination of two or more thereof.

The polymerization initiator can be an initiator soluble in the polymerizable monomer, and a peroxide initiator or an azo initiator known in the art can be used. Particularly, an azo initiator can be used. Examples of the azo initiator include 2,2'-azobisisobutyronitrile, 1,1'-azobiscyclohexane-1-carbonitrile and 2,2'-azobis-4-methoxy-2,4-dimethylvaleronitrile. Particularly, 2,2'-azobisisobutyronitrile can be used. The amount of the polymerization initiator used can be 0.01 to 5 parts by mass with respect to 100 parts by mass of the polymerizable monomer.

An anionic surfactant, a cationic surfactant, a nonionic surfactant, an amphoteric surfactant or a polymer dispersant can be used as the surfactant. The amount of the surfactant used can be 0.01 to 10 parts by mass with respect to 100 parts by mass of the polymerizable monomer.

Examples of the dispersion stabilizer include organic fine particles (fine polystyrene particles, fine polymethyl methacrylate particles, fine polyacrylic acid particles and fine polyepoxide particles, etc.), silica (colloidal silica, etc.), calcium carbonate, calcium phosphate, aluminum hydroxide, barium carbonate and magnesium hydroxide. The amount of the dispersion stabilizer used can be 0.01 to 20 parts by mass with respect to 100 parts by mass of the polymerizable monomer.

The suspension polymerization can be hermetically performed using a pressure resistant container. Also, the starting materials for polymerization may be suspended in a dispersing machine or the like, then transferred into the pressure resistant container and suspension-polymerized, or may be suspended in the pressure resistant container. The polymerization temperature can be 50° C. to 120° C. The polymerization may be performed at atmospheric pressure and can be performed under pressure (under pressure of 0.1 to 1 MPa plus atmospheric pressure) in order to prevent the volatilization of the material to be contained in the thermally expandable microcapsule. After the completion of polymerization, solid-liquid separation and washing may be performed by centrifugation or filtration. In the case of performing solid-liquid separation or washing, drying or pulverization may then be performed at a temperature equal to or lower than the softening temperature of the resin constituting the thermally expandable microcapsule. The drying and the pulverization can be performed by a known method, and a flash dryer, a fair wind dryer or Nauta-Mixer can be used. Alternatively, the drying and the pulverization may be performed at the same time using a crushing dryer. The surfactant and the dispersion stabilizer can be removed by repeating washing and filtration after production.

The Martens' hardness of the insulating particle is not particularly limited and can be smaller than the Martens' hardness upon indentation with strength of 0.04 mN at the core surface defined according to the three dimensional surface texture standard.

The Martens' hardness of the insulating particle can be measured in the same way as in the measurement of the Martens' hardness of the core surface. Hardness upon indentation of an indenter with strength of 0.04 mN is extracted from results of measurement by using the microscope attached to the microhardness measurement apparatus and contacting the indenter with the insulating particle, and used as the Martens' hardness of the insulating particle. This measurement is performed for 10 insulating particles, and the 10 measurement values are averaged to calculate the average Martens' hardness of the insulating particle. In the Martens' hardness measurement, the form of the particle may be the starting material itself or may be the particle exposed on the surface layer of the charging member.

The volume average particle size of the insulating particle can be 6 μm or larger and 45 μm or smaller. Provided that the volume average particle size is 6 μm or larger, poor images with horizontal lines resulting from intermittent downstream electric discharge due to insufficient electric discharge at an upstream site in the rotational direction of the photosensitive member can be easily suppressed. Provided that the volume average particle size is 45 μm or smaller, image unevenness caused by insufficient charging at a site with small surface roughness near the protrusion can be easily prevented. The volume average particle size is determined by the following method: the charging member is orthographically projected onto the surface of an electroconductive substrate, and a face parallel to the surface of the projection site is cut with a focused ion beam (trade name: FB-2000C, manufactured by Hitachi, Ltd.) while a cross sectional image is taken. Diameters and volumes when 50 insulating particles randomly selected based on this cross sectional image are spherically approximated are individually determined, and the volume average particle size of the 50 insulating particles is calculated from these values. The method for measuring this "volume average particle size" is referred to as "evaluation 5" in Examples.

[Other Particles]

In addition to the insulating particle, an electroconductive particle such as a fine particle or fiber of a metal such as aluminum, palladium, iron, copper or silver, a metal oxide such as titanium oxide, tin oxide or zinc oxide, a composite particle of the fine metal particle, the metal fiber or the metal oxide surface-treated by electrolytic treatment, spray coating or mixing and shaking, or a carbon particle such as graphite or carbon glass can be used as a particle for the roughening of the surface layer.

<Electroconductive Support>

The electroconductive support is not particularly limited as long as the electroconductive support has electroconductivity, is capable of supporting, for example, the electroconductive elastic layer which is a surface layer, and is capable of maintaining strength as the charging member, typically a charging roller. When the charging member is a charging roller, the electroconductive support is a solid columnar body or a hollow cylindrical body having a length on the order of, for example, 240 to 360 mm and an outer diameter on the order of, for example, 4.5 to 9 mm.

<Method for Producing Charging Member>

A method effective from the viewpoint of a simple production process will be described as one example of a method for producing the charging member.

The production method is a method for producing a charging roller, including the following 3 steps:

step 1: preparing an unvulcanized rubber composition including a rubber composition and an insulating particle;

step 2: supplying the electroconductive support and the unvulcanized rubber composition to a crosshead extrusion molding machine and taking up the resultant under conditions involving a take-up rate exceeding 100% to obtain an unvulcanized rubber roller having a layer of the unvulcanized rubber composition on the periphery of the electroconductive support; and step 3: vulcanizing the layer of the unvulcanized rubber composition in air, followed by surface treatment to obtain the electroconductive elastic layer.

In the step 1, an unvulcanized rubber composition including an electroconductive rubber composition and an insulating particle constituting the electroconductive elastic layer which is a surface layer is prepared. The content of the insulating particle in the unvulcanized rubber composition can be 5 parts by mass or larger and 50 parts by mass or smaller with respect to 100 parts by mass of the raw rubber. 5 parts by mass or larger of the insulating particle are easily allowed to exist on the surface of the electroconductive elastic layer and can create the surface potential gradient of the photosensitive member within an adequate range. 50 parts by mass or smaller of the insulating particle can easily suppress the inhibition of toner movement by a large abundance of the insulating particle on the surface of the electroconductive elastic layer. However, when the insulating particle is a balloon-shaped particle, the content of the balloon-shaped particle in the rubber composition can be 2 parts by mass or larger and 20 parts by mass or smaller with respect to 100 parts by mass of the raw rubber. This is because the balloon-shaped particle has a smaller specific gravity than that of a solid particle.

In the step 2, the electroconductive support (cored bar) and the unvulcanized rubber composition are supplied to a crosshead extrusion molding machine, and the resultant is taken up under conditions involving a take-up rate exceeding 100% to obtain an unvulcanized rubber roller having a layer of the unvulcanized rubber composition on the periphery of the electroconductive support. The crosshead extrusion molding machine is a molding machine where the unvulcanized rubber composition and the cored bar having a predetermined length are sent at the same time and the unvulcanized rubber roller with the perimeter of the cored bar evenly covered with the unvulcanized rubber composition having a predetermined thickness is extruded from the outlet of the crosshead. Use of the crosshead extrusion molding machine can easily and moderately roughen the surface of the electroconductive elastic layer.

Figure 5A:
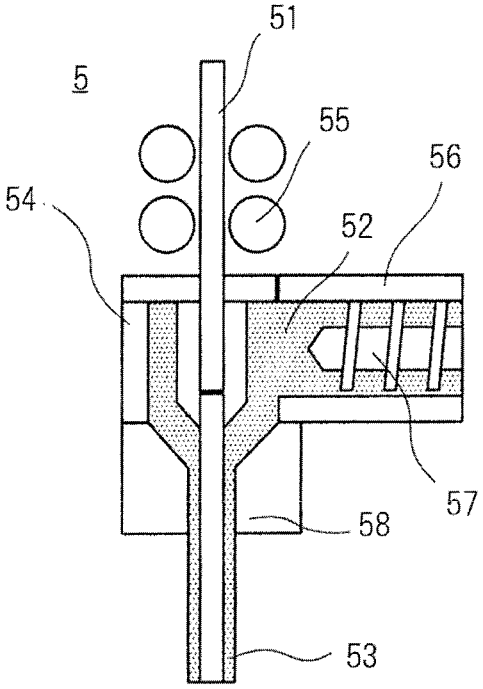
FIGS. 5A and 5B are schematic block diagrams of one example of a crosshead extrusion molding machine.

FIG. 5A is a schematic block diagram of crosshead extrusion molding machine 5. The crosshead extrusion molding machine can produce unvulcanized rubber roller 53 having cored bar 51 at the center by evenly and wholly covering the perimeter of the cored bar 51 with unvulcanized rubber composition 52. The crosshead extrusion molding machine is provided with the cored bar 51, crosshead 54 to which the unvulcanized rubber composition 52 is sent, conveyance roller 55 which sends the cored bar 51 to the crosshead 54, and cylinder 56 which sends the unvulcanized rubber composition 52 to the crosshead 54. The conveyance roller 55 can continuously send a plurality of cored bars 51 to the crosshead 54. The cylinder 56 has screw 57 in the inside thereof and can send the unvulcanized rubber composition 52 into the crosshead 54 by the rotation of the screw 57.

The cored bar 51 sent into the crosshead 54 is covered at its whole circumference with the unvulcanized rubber composition 52 sent from the cylinder 56 into the crosshead. Then, the cored bar 51 is sent out, as unvulcanized rubber roller 53 covered at its surface with the unvulcanized rubber composition 52, from die 58 at the outlet of the crosshead 54. The unvulcanized rubber composition can be molded into a so-called crown shape having a larger outer diameter (material thickness) at the central part in the longitudinal direction of each cored bar 51 than that at the end part. In this way, the unvulcanized rubber roller 53 can be obtained.

Figure 5B:
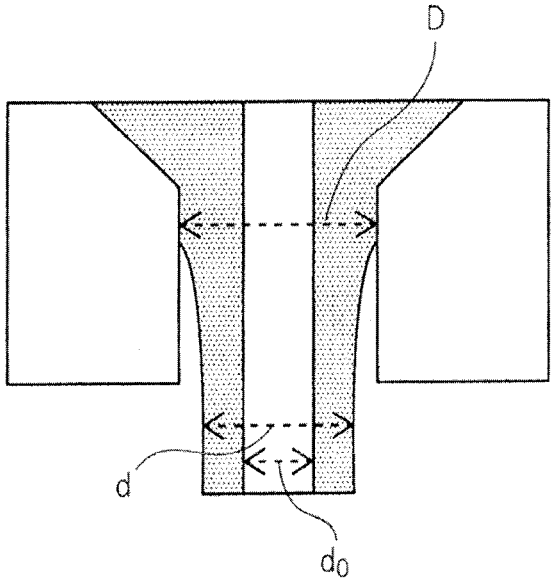

The unvulcanized rubber composition can be molded such that the thickness of the unvulcanized rubber composition is larger than the gap of an extrusion orifice of the crosshead, because a depression can be prevented from being formed by the delamination of the interface between the insulating particle and the electroconductive rubber composition so that the Svk value of the surface of the charging member can fall within an adequate range. FIG. 5B illustrates a schematic diagram of the crosshead extrusion orifice and its neighborhood. The inner diameter of the die in the crosshead extrusion orifice is represented by D. The outer diameter of the unvulcanized rubber roller is represented by d. The outer diameter of the cored bar is represented by $d_0$. A take-up rate (%) is defined as "$100\times(d-d_0)/(D-d_0)$" which corresponds to "100×(Layer thickness of the unvulcanized rubber composition)/(Gap of the extrusion orifice)". This value of 100% means the same layer thickness of the unvulcanized rubber composition as the gap of the extrusion orifice. As this take-up rate is larger, the formation of the protrusion can be promoted and the formation of the depression can be suppressed. However, if the take-up rate exceeds 110%, the crown shape is difficult to form. Therefore, the take-up rate can be around 105% for molding.

In the step 3, the layer of the unvulcanized rubber composition on the periphery of the electroconductive support is vulcanized in air, followed by surface treatment. The vulcanization of the layer of the unvulcanized rubber composition is performed by heating. Specific examples of the heating treatment method can include hot air oven heating using a gear oven, and heating by far-infrared radiation. The vulcanization can be performed with the surface of the unvulcanized rubber roller contacted with air. Particularly, the hot air oven heating is preferred because air can be intermittently supplied to the surface. The presence of air during the vulcanization permits oxidative curing of the topmost surface of the layer of the unvulcanized rubber composition. Therefore, the viscosity can be reduced while the average Martens' hardness Mc of the core surface is kept at 2 $N/mm^2$ or larger and 20 $N/mm^2$ or smaller. The vulcanized rubber composition at both end parts of the electroconductive support are removed in a later step to obtain a vulcanized rubber roller. Thus, in the obtained vulcanized rubber roller, both end parts of the cored bar are exposed.

The topmost surface of the layer of the vulcanized rubber composition is further oxidatively cured by the surface treatment of the surface of the layer of the vulcanized rubber composition in the vulcanized rubber roller. As a result, the viscosity of the surface of the layer of the vulcanized rubber composition can be reduced to obtain the charging member according to one aspect of the present invention having the electroconductive elastic layer. The surface treatment method can be ultraviolet irradiation from the viewpoint of a simple production process and from the viewpoint of reducing only the viscosity without increasing the Martens' hardness.

Alternative examples of the method for producing the charging member include the following methods (1) and (2):

(1) a method which involves roughening the surface of the extrusion-molded rubber composition by a rolling step in a state reheated at the same temperature as the extrusion molding temperature, and then vulcanizing the resultant in air at a temperature that completes the vulcanization in an approximately 30 minutes to approximately 1 hour, followed by the ultraviolet irradiation of the surface; and (2) a method which involves applying the insulating particle to the surface of the rubber roller extrusion-molded from the rubber composition in a state reheated at the same temperature as the extrusion molding temperature, and vulcanizing the resultant in air at a temperature that is higher than the melting point of the resin constituting the insulating particle and completes the vulcanization in an approximately 30 minutes to approximately 1 hour so that the insulating particle comes in close contact with the surface of the vulcanized rubber roller, followed by the ultraviolet irradiation of the surface.

As compared with these methods, the production method including the steps 1 to 3 is preferred from the viewpoint that a production process is simple and materials are easily selected.

<Electrophotographic Image Forming Apparatus>

Figure 6:
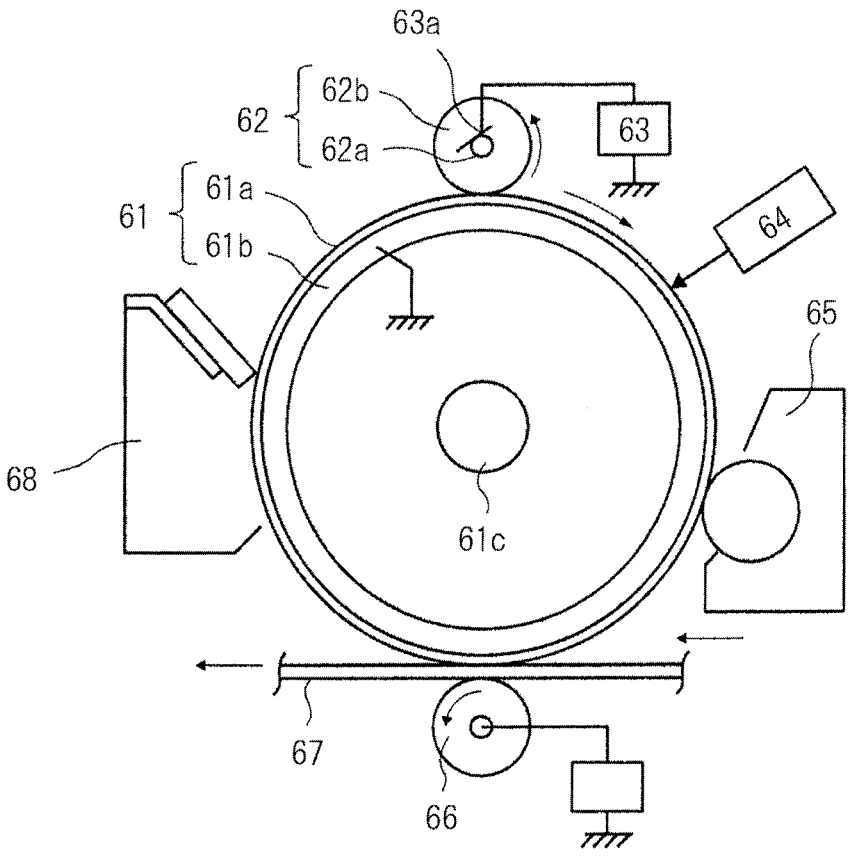
FIG. 6 is a diagram illustrating one example of the electrophotographic image forming apparatus according to the present invention.

The electrophotographic image forming apparatus according to one aspect of the present invention has an electrophotographic photosensitive member and a charging member which charges the electrophotographic photosensitive member, the charging member being the aforementioned charging member according to one aspect of the present invention. FIG. 6 illustrates the schematic configuration of one example of the electrophotographic image forming apparatus. The electrophotographic image forming apparatus includes electrophotographic photosensitive member 61, charging member 62, exposure unit 64, developing member 65, transfer unit 66, cleaning member 68, etc. An electrophotographic image forming process will be described with reference to FIG. 6. The electrophotographic photosensitive member (photosensitive member) 61 to be charged includes electroconductive support 61*b* and photosensitive layer 61*a* formed on the support 61*b* and has a cylindrical shape. The electrophotographic photosensitive member 61 is driven with a predetermined peripheral velocity in a clockwise fashion on the drawing around axis 61*c*.

The charging member (charging roller) 62 is positioned in contact with the photosensitive member 61 and charges the photosensitive member with a predetermined potential. The charging roller 62 includes electroconductive support 62*a* and surface layer (electroconductive elastic layer) 62*b* formed thereon. Both end parts of the electroconductive support 62*a* are pressed against the photosensitive member 61 by a pressing unit (not shown). A predetermined DC voltage is applied to the electroconductive support 62*a* via sliding electrode 63*a* from power source 63 so that the photosensitive member 61 is charged with a predetermined potential.

Subsequently, electrostatic latent images are formed in response to image information of interest on the periphery of the charged photosensitive member 61 by the exposure unit 64. The electrostatic latent images are then sequentially visualized as toner images by the developing member 65. These toner images are sequentially transferred to transfer materials 67. Each transfer material 67 is conveyed from a paper feed unit (not shown) to a transfer part between the photosensitive member 61 and the transfer unit 66 at an adequate timing in synchronization with the rotation of the photosensitive member 61. The transfer unit 66 is a transfer roller and charges the transfer material 67 from the backside with polarity opposite to that of the toner so that the toner image on the photosensitive member 61 side is transferred to the transfer material 67. The transfer material 67 with the toner image transferred on the surface is separated from the photosensitive member 61 and conveyed to a fixing unit (not shown) where the toner is fixed to output a formed image. Toner or the like remaining on the surface of the photosensitive member 61 after the image transfer is removed by the cleaning unit 68 having a cleaning member typified by an elastic blade. The periphery of the cleaned photosensitive member 61 proceeds to a next cycle of the electrophotographic image forming process.

<Process Cartridge>

The process cartridge according to one aspect of the present invention is detachably attachable to a main body of an electrophotographic image forming apparatus. The process cartridge includes an electrophotographic photosensitive member and a charging member which charges the electrophotographic photosensitive member, the charging member being the charging member according to one aspect of the present invention.

According to one aspect of the present invention, a charging member that stabilizes the surface potential of a photosensitive member and attains uniform charging even when toner, external additives or the like adhere and accumulate on the surface of the charging member with increase in the number of prints, can be obtained.

According to another aspect of the present invention, a process cartridge and an electrophotographic image forming apparatus that contribute to the formation of a high quality electrophotographic image, can be obtained.

EXAMPLES

Hereinafter, the present invention will be described in more detail with reference to specific Production Examples and Examples. However, these examples are not intended to limit the present invention. A method for measuring the volume average particle size of a thermally expandable microcapsule particle (hereinafter, referred to as a "capsule particle") serving as a material for the formation of a balloon-shaped resin particle, a method for measuring the volume resistivity of a particle, and Production Examples 1 to 7 will be described prior to Examples. Production Examples 1 to 7 are methods for producing capsule particles 1 to 7, respectively. Commercially available highly pure products are used as reagents, etc. unless otherwise specified. In each example, a charging roller was prepared.

[Evaluation A] Method for Measuring Volume Average Particle Size of Capsule Particle The average particle size of a capsule particle is a "volume average particle size" determined by the following method.

The measurement equipment used is a laser diffraction particle size distribution analyzer (trade name: Coulter particle size distribution analyzer model LS-230, manufactured by Beckman Coulter Inc.). The inside of the measurement system of the particle size distribution analyzer is washed with pure water for approximately 5 minutes, and 10 mg to 25 mg of sodium sulfite is added as a defoaming agent into the measurement system to carry out background functions. Next, 3 to 4 drops of a surfactant are added into 50 ml of pure water, and 1 mg to 25 mg of a measurement sample is further added thereto. The aqueous solution of the sample suspended therein is subjected to dispersion treatment for 1 to 3 minutes in an ultrasonic dispersing machine to prepare a test sample solution. The test sample concentration in the measurement system is adjusted by the gradual addition of the test sample solution into the measurement system of the measurement apparatus such that PIDS on the display of the apparatus is 45% or more and 55% or less, followed by measurement. The volume average particle size is calculated from the obtained volume distribution.

[Evaluation B] Method for Measuring Volume Resistivity of Particle

The volume resistivities of a capsule particle, a resin particle and a carbon particle used as particles for a surface layer are measured by the approach mentioned above. As for the electroconductive characteristics of the particles, a volume resistivity of $10^{10}$ Ωcm or more indicates insulating properties, and a volume resistivity of $10^{3}$ Ωcm or less indicates electroconductivity.

Production Example 1

An aqueous mixed solution of 4000 parts by mass of ion exchange water and 9 parts by mass of colloidal silica and 0.15 parts by mass of polyvinylpyrrolidone as dispersion stabilizers was prepared. Subsequently, an oily mixed solution containing 50 parts by mass of acrylonitrile, 45 parts by mass of methacrylonitrile and 5 parts by mass of methyl methacrylate as polymerizable monomers, 5.0 parts by mass of isopentane and 7.5 parts by mass of normal hexane as core materials, and 0.75 parts by mass of dicumyl peroxide as a polymerization initiator was prepared. This oily mixed solution was added to the aqueous mixed solution, and 0.4 parts by mass of sodium hydroxide were further added thereto to prepare a dispersion.

The obtained dispersion was stirred and mixed for 3 minutes using a homogenizer, added into a nitrogen-purged polymerization reaction vessel, and reacted at 60° C. for 20 hours with stirring at 200 rpm to prepare a reaction product. The obtained reaction product was repetitively subjected to filtration and washing with water and then dried at 80° C. for 5 hours to prepare capsule particles.

The obtained capsule particles were sifted using a dry air classifier (trade name: Classiel N-20, manufactured by Seishin Enterprise Co., Ltd.) to obtain capsule particle 1. The classification conditions involved the number of rotations of 1500 rpm for a classification rotor. The obtained capsule particle had a volume average particle size of 10.0 μm and a volume resistivity of $10^{10}$ Ωcm or more.

Production Example 2

Capsule particle 2 was obtained in the same way as in Production Example 1 except that the core materials were changed to 12.5 parts by mass of normal hexane. The obtained capsule particle had a volume average particle size of 10.0 μm and a volume resistivity of $10^{10}$ Ωcm or more.

Production Example 3

Capsule particle 3 was obtained in the same way as in Production Example 1 except that the core materials were changed to 5.0 parts by mass of normal hexane and 7.5 parts by mass of normal heptane. The obtained capsule particle had a volume average particle size of 10.0 μm and a volume resistivity of $10^{10}$ Ωcm or more.

Production Example 4

Capsule particle 4 was obtained in the same way as in Production Example 1 except that the core materials were changed to 12.5 parts by mass of normal heptane. The obtained capsule particle had a volume average particle size of 10.0 μm and a volume resistivity of $10^{10}$ Ωcm or more.

Production Example 5

Capsule particle 5 was obtained in the same way as in Production Example 1 except that the number of rotations of the classification rotor was changed to 1430 rpm. The obtained capsule particle had a volume average particle size of 12.5 μm and a volume resistivity of $10^{10}$ Ωcm or more.

Production Example 6

Capsule particle 6 was obtained in the same way as in Production Example 1 except that: the amount of the colloidal silica was changed to 12 parts by mass; the number of rotations of the homogenizer was changed to 1000 rpm; and the number of rotations of the classification rotor was changed to 1720 rpm. The obtained capsule particle had a volume average particle size of 5.0 μm and a volume resistivity of $10^{10}$ Ωcm or more.

Production Example 7

Capsule particle 7 was obtained in the same way as in Production Example 1 except that: the amount of the colloidal silica was changed to 5 parts by mass; the number of rotations of the homogenizer was changed to 100 rpm; and the number of rotations of the classification rotor was changed to 1350 rpm. The obtained capsule particle had a volume average particle size of 15.5 μm and a volume resistivity of $10^{10}$ Ωcm or more.

Example 1

1. Electroconductive Substrate

A thermosetting resin containing 10% by mass of carbon black was applied to the perimeter of a cylindrical substrate made of stainless steel with a diameter of 6 mm and a length of 252.5 mm and dried, and the resultant was used as an electroconductive substrate.

2. Preparation of Unvulcanized Rubber Composition for Surface Layer 50 parts by mass of carbon black (trade name: TOKABLACK #7360SB, manufactured by Tokai Carbon Co., Ltd.), 5 parts by mass of zinc oxide (trade name: Zinc Flower Class 2, manufactured by Sakai Chemical Industry Co., Ltd.), 30 parts by mass of calcium carbonate (trade name: Super 1700, manufactured by Maruo Calcium Co., Ltd.) and 1 part by mass of zinc stearate were added with respect to 100 parts by mass of acrylonitrile-butadiene rubber (trade name: N230SV, manufactured by JSR Corp.), and the mixture was kneaded for 15 minutes in a hermetically sealed mixer adjusted to 50° C. Subsequently, 5 parts by mass of capsule particle 1, 1 part by mass of sulfur and 4 parts by mass of tetrabenzyl thiuram disulfide (TBzTD) (trade name: Nocceler TBZTD, manufactured by Ouchi Shinko Chemical Industrial Co., Ltd.) were added thereto, and the mixture was kneaded for 10 minutes in a double roll machine cooled to a temperature of 25° C. to obtain an unvulcanized rubber composition.

3. Formation of Vulcanized Rubber Roller

A crosshead extrusion molding machine was used. The machine was operated at a molding temperature of 100° C., the number of screw rotations of 9 rpm and varying electroconductive substrate feed speeds to form a covering layer of the unvulcanized rubber composition on the perimeter of the electroconductive substrate. The average take-up rate of the unvulcanized rubber roller was set to 107%. The crosshead extrusion molding machine had a die inner diameter of 8.0 mm, and the unvulcanized rubber roller had a crown shape with an outer diameter of 8.25 mm at the center in the axial direction and an outer diameter of 8.10 mm at positions of 100 mm each distant from the center toward both ends. Then, the unvulcanized rubber layer was vulcanized by heating at a temperature of 160° C. for 1 hour in an electrical hot air oven in an air atmosphere, and both end parts of the vulcanized rubber layer were cut off to obtain a vulcanized rubber roller having a length of 232 mm in the axial direction.

4. Surface Treatment of Surface Layer

The vulcanized rubber roller was irradiated with ultraviolet rays with a wavelength of 254 nm at an integrated amount of light of 9000 mJ/cm$^2$ for surface treatment. A low pressure mercury lamp [manufactured by Harison Toshiba Lighting Corp.] was used in the ultraviolet irradiation. In this way, charging roller No. 1 was obtained. Each evaluation was conducted as described below.

[Evaluation 1] Calculation of Average Martens' Hardness of Core Surface and Convex Part The Martens' hardness of the core surface and the convex part was measured by the approach mentioned above. The average Martens' hardness Mc of the core surface was 8.2 N/mm$^2$, and the average Martens' hardness Mp of the convex part was 4.3 N/mm$^2$.

[Evaluation 2] Calculation of Average Viscosity

The average viscosity of the core surface was measured by the approach mentioned above. The average viscosity Vc was $61.2\times10^{-3}$ V.

[Evaluation 3] Measurement of Spk, Svk and Sk According to Three Dimensional Surface Texture Standard The values of Spk, Svk and Sk were calculated by the approaches mentioned above. Spk was 7.1 μm, Svk was 2.7 μm, and Sk was 10.1 μm. The sum of Spk, Svk and Sk was 19.9 μm. Thus, the surface layer was considered to have a roughened surface. In subsequent Examples and Comparative Examples, the roughening is indicated by "absent" when the sum of Spk, Svk and Sk was smaller than 3 μm, and indicated by "present" when the sum of Spk, Svk and Sk was 3 μm or larger, in Tables 4 to 6.

[Evaluation 4] Observation of Particle

Particles on the surface of the charging roller were observed under a confocal microscope (trade name: Optelics Hybrid, manufactured by Lasertec Corp.). The observation was performed under conditions involving a 50× objective lens, the number of pixels of 1024 and a height resolution of 0.1 μm. The particles existed in an exposed state.

[Evaluation 5] Observation of Particle Size and Particle Shape

The volume average particle size of particles present in the surface layer of the charging roller was calculated using a cross sectional image obtained by cutting with the focused ion beam mentioned above (trade name: FB-2000C, manufactured by Hitachi, Ltd.). The calculated particle size was 24 μm.

Whether or not the shape of a particle was a balloon shape was also determined by observing the void volume of the particle in the cross sectional image. The particle of Example 1 exhibited a balloon shape. A particle was considered to have a balloon shape when 80% or more of the cross sectional area of the particle was a void. In subsequent Examples and Comparative Examples, the same criteria for determination were used.

[Image Evaluation 1] Evaluation of Image Density Difference by Durability Test

The prepared charging roller was mounted to a black cartridge of an electrophotographic apparatus (trade name: LBP7200C, manufactured by Canon Inc., for A4 paper output on a portrait mode) modified such that the output speed of recording media was 180 mm/sec. Images were output with this modified apparatus in an environment involving a temperature of 25° C. and a relative humidity of 50%.

The image output conditions involved using images in which 3 area % was randomly printed at a position of 80 mm to 130 mm (central part) from the end part of an image forming region of A4 paper, and outputting 20,000 images by repeating the operation of stopping the operation of the electrophotographic apparatus with each image output and restarting the image forming operation after 10 seconds. After the output of 20,000 images, one image for evaluation was output. The image for evaluation was an image in which a halftone image (intermediate density image composed of horizontal lines with a 1 dot width drawn at 2 dot intervals in a direction perpendicular to the rotational direction of the photosensitive member) was printed throughout the image forming region of A4 paper. This image for evaluation was visually observed and evaluated based on the criteria described below. In the evaluation criteria described below, the "non-central part" refers to a position of 50 mm to 80 mm from the end part of the image forming region of A4 paper.

Rank A: No density difference was found between the central part and the non-central part.

Rank B: Almost no density difference was found between the central part and the non-central part.

Rank C: A density difference was found between the central part and the non-central part to some extent.

Rank D: A marked density difference was found between the central part and the non-central part.

In Example 1, the image density difference between the central part and the non-central part was rated as rank A. Thus, high image quality was maintained.

[Image Evaluation 2] Potential Variation Value by Durability Test

The charging roller after the output of 20,000 images was installed in a new black cartridge. A developing machine was replaced with a photosensitive member potential measurement tool mountable to the developing machine. The surface potential difference of the photosensitive member between the central part (position of 100 mm from the end part) and the non-central part (position of 60 mm from the end part) was measured during printing of a white image throughout the surface of A4 paper. The difference was evaluated as a potential variation value by the durability test. The potential variation value of Example 1 was 5.7 V.

[Image Evaluation 3] Evaluation of Image Uniformity at Non-Central Part

The image for evaluation used in image evaluation 1 was visually observed. The presence or absence of image density unevenness at the non-central part and the degree of the unevenness were evaluated based on the following criteria.

Rank A: Image density unevenness was absent.

Rank B: Image density unevenness was absent, though the image had granular quality.

Rank C: Minor image density unevenness was present to an extent that was not practically significant.

Rank D: Image density unevenness was present and impaired image quality.

In Example 1, the image density unevenness of the non-central part was rated as rank A. Thus, high image quality was maintained.

Examples 2 to 19

Charging roller Nos. 2 to 19 were prepared in the same way as in Example 1 except that the types of materials for surface layer formation, the amounts of the materials added, a take-up rate for extrusion molding, vulcanization temperature conditions and surface treatment conditions were as described in Table 1 or 2. Evaluation results are shown in Table 4 or 5.

Examples 20 to 24

Charging roller Nos. 20 to 24 were prepared in the same way as in Example 1 except that a PMMA particle (trade name: GANZPEARL GM0801, Aica Kogyo Co., Ltd.), a PMMA particle (trade name: GANZPEARL GM3001, Aica Kogyo Co., Ltd.), a polyethylene particle (trade name: MIPELON PM200, Mitsui Chemicals, Inc.), a polyurethane particle (trade name: Dynamic Beads UCN-8150CM, Dainichiseika Color & Chemicals Mfg. Co., Ltd.) and a carbon particle (Glassy Carbon, Tokai Carbon Co., Ltd.) were respectively used instead of the capsule particle 1 of Example 1. The charging roller production conditions are shown in Table 2 or 3, and evaluation results are shown in Table 5 or 6.

Comparative Examples 1 to 4

Charging roller Nos. C1 to C4 were obtained in the same way as in Example 1 except that the types of materials for surface layer formation, the amounts of the materials added, a take-up rate for extrusion molding, vulcanization temperature conditions and surface treatment conditions were as described in Table 3. In Comparative Example 1 compared with Example 1, the type of the capsule particle was changed, the amounts of sulfur and the vulcanization accelerator used were increased, and the vulcanization temperature was high. In Comparative Example 2 compared with Example 1, the amounts of sulfur and the vulcanization accelerator used were decreased, and the vulcanization temperature was low. In Comparative Example 3, no particle was used. In Comparative Example 4, the raw rubber used was epichlorohydrin rubber. Evaluation results are shown in Table 6.

Comparative Example 5

Charging roller No. C5 was prepared and evaluated in the same way as in Example 1 except that ultraviolet irradiation was not performed. Evaluation results are shown in Table 6.

Comparative Example 6

Charging roller No. C6 was prepared and evaluated in the same way as in Example 1 except that the surface of a formed vulcanized rubber roller was ground using a cylindrical plunge grinding machine, followed by ultraviolet irradiation. Evaluation results are shown in Table 6. The grinding was performed as follows: a vitrified grinding stone was used as a grinding grain, and the grain was green silicon carbide (GC) having a grain size of 100 mesh. The number of roller rotations was set to 400 rpm, and the number of grinding stone rotations was set to 2500 rpm. The incision rate was set to 20 mm/min, and the spark out time (time at 0 mm incision) was set to 1 second. The grinding was performed such that the grinding margin was 400 μm in the outer diameter of the vulcanized rubber roller and the outer diameter difference between the center and the end part was 200 μm.

TABLE 1

| | | Example | | | | | | | | | |
|---|---|---|---|---|---|---|---|---|---|---|---|
| | | 1 | 2 | 3 | 4 | 5 | 6 | 7 | 8 | 9 | 10 |
| Amount | NBR ("JSR N230SL", JSR Corp.) | 100 | 100 | 100 | 100 | 100 | 100 | | | | 100 |
| added | NBR ("JSR N215SL", JSR Corp.) | | | | | | | 100 | | | |
| [parts by | SBR ("JSR SL552", JSR Corp.) | | | | | | | | 100 | | |

TABLE 1-continued

| | | Example | | | | | | | | | |
|---|---|---|---|---|---|---|---|---|---|---|---|
| | | 1 | 2 | 3 | 4 | 5 | 6 | 7 | 8 | 9 | 10 |
| mass] | BR ("JSR BR51", JSR Corp.) | | | | | | | | | 100 | |
| | Epichlorohydrin rubber ("Epion 301", Osaka Soda Co., Ltd.) | | | | | | | | | | |
| | Carbon black | 50 | 50 | 50 | 50 | 50 | 50 | 50 | 50 | 50 | 50 |
| | Zinc oxide | 5 | 5 | 5 | 5 | 5 | 5 | 5 | 5 | 5 | 5 |
| | Zinc stearate | 1 | 1 | 1 | 1 | 1 | 1 | 1 | 1 | 1 | 1 |
| | Calcium carbonate | 30 | 30 | 30 | 30 | 30 | 30 | 30 | 30 | 30 | 30 |
| | Sulfur | 1 | 2 | 0.5 | 1.5 | 3 | 0.5 | 1 | 1 | 1 | 1 |
| | "Nocceler TBzTD" | 4 | 4 | 4 | 3 | 2 | 3 | 4.5 | 4 | 3.5 | 4 |
| | Capsule particle 1 | 5 | | 5 | 5 | | 5 | 5 | 5 | 5 | |
| | Capsule particle 2 | | | | | 5 | | | | | |
| | Capsule particle 3 | | 5 | | | | | | | | |
| | Capsule particle 4 | | | | | | | | | | |
| | Capsule particle 5 | | | | | | | | | | 5 |
| | Capsule particle 6 | | | | | | | | | | |
| | Capsule particle 7 | | | | | | | | | | |
| | PMMA particle ("GANZPEARL GM0801", Aica Kogyo Co., Ltd.) | | | | | | | | | | |
| | PMMA particle ("GANZPEARL GM3001", Aica Kogyo Co., Ltd.) | | | | | | | | | | |
| | Polyethylene particle ("MIPELON PM200", Mitsui Chemicals, Inc.) | | | | | | | | | | |
| | Polyurethane particle ("Dynamic Beads UCN-8150CM", Dainichiseika Color & Chemicals Mfg. Co., Ltd.) | | | | | | | | | | |
| | Carbon particle ("Glassy Carbon", Tokai Carbon Co., Ltd.) | | | | | | | | | | |
| Extrusion molding condition | Take-up rate: 107% | applied | applied | applied | applied | applied | applied | applied | applied | applied | applied |
| | Take-up rate: 101% | | | | | | | | | | |
| | Take-up rate: 94% | | | | | | | | | | |
| Vulcanization temperature condition | 160° C. 1 hr | applied | | applied | | | | applied | applied | applied | applied |
| | 145° C. 1 hr | | | | applied | | applied | | | | |
| | 175° C. 1 hr | | | | | applied | | | | | |
| | 190° C. 1 hr | | applied | | | | | | | | |
| | 210° C. 1 hr | | | | | | | | | | |
| Surface treatment condition | Ultraviolet irradiation Integrated amount of light: 9000 mJ/cm2 | applied | applied | applied | | | | applied | applied | applied | applied |
| | Ultraviolet irradiation Integrated amount of light: 3000 mJ/cm2 | | | | applied | applied | applied | | | | |
| Surface treatment condition | Grinding treatment | | | | | | | | | | |

TABLE 2

| | | Example | | | | | | | | | |
|---|---|---|---|---|---|---|---|---|---|---|---|
| | | 11 | 12 | 13 | 14 | 15 | 16 | 17 | 18 | 19 | 20 |
| Amount added [parts by mass] | NBR ("JSR N230SL", JSR Corp.) | 100 | 100 | 100 | 100 | 100 | 100 | 100 | 100 | 100 | 100 |
| | NBR ("JSR N215SL", JSR Corp.) | | | | | | | | | | |
| | SBR ("JSR SL552", JSR Corp.) | | | | | | | | | | |
| | BR ("JSR BR51", JSR Corp.) | | | | | | | | | | |
| | Epichlorohydrin rubber ("Epion 301", Osaka Soda Co., Ltd.) | | | | | | | | | | |
| | Carbon black | 50 | 50 | 50 | 50 | 50 | 50 | 50 | 50 | 50 | 50 |
| | Zinc oxide | 5 | 5 | 5 | 5 | 5 | 5 | 5 | 5 | 5 | 5 |
| | Zinc stearate | 1 | 1 | 1 | 1 | 1 | 1 | 1 | 1 | 1 | 1 |
| | Calcium carbonate | 30 | 30 | 30 | 15 | 20 | 15 | 30 | 30 | 15 | 30 |
| | Sulfur | 1 | 1 | 1 | 1 | 1 | 0.5 | 1 | 1 | 1 | 1 |
| | "Nocceler TBzTD" | 4 | 4 | 4 | 4 | 4 | 3 | 4 | 4 | 4 | 4 |
| | Capsule particle 1 | | | | | | 5 | 5 | 5 | 5 | |
| | Capsule particle 2 | | | | | | | | | | |
| | Capsule particle 3 | | | | | | | | | | |
| | Capsule particle 4 | | | | | | | | | | |
| | Capsule particle 5 | | | | 5 | 5 | | | | | |
| | Capsule particle 6 | 5 | | 5 | | | | | | | |
| | Capsule particle 7 | | 5 | | | | | | | | |
| | PMMA particle ("GANZPEARL GM0801", Aica Kogyo Co., Ltd.) | | | | | | | | | | 30 |
| | PMMA particle ("GANZPEARL GM3001", Aica Kogyo Co., Ltd.) | | | | | | | | | | |

TABLE 2-continued

| | | Example | | | | | | | | | |
|---|---|---|---|---|---|---|---|---|---|---|---|
| | | 11 | 12 | 13 | 14 | 15 | 16 | 17 | 18 | 19 | 20 |
| | Polyethylene particle ("MIPELON PM200", Mitsui Chemicals, Inc.) | | | | | | | | | | |
| | Polyurethane particle ("Dynamic Beads UCN-8150CM", Dainichiseika Color & Chemicals Mfg. Co., Ltd.) | | | | | | | | | | |
| | Carbon particle ("Glassy Carbon", Tokai Carbon Co., Ltd.) | | | | | | | | | | |
| Extrusion molding condition | Take-up rate: 107% | applied | applied | applied | applied | applied | applied | | | | applied |
| | Take-up rate: 101% | | | | | | | applied | | | |
| | Take-up rate: 94% | | | | | | | | applied | applied | |
| Vulcanization temperature condition | 160° C. 1 hr | applied | applied | | | applied | | applied | applied | applied | applied |
| | 145° C. 1 hr | | | | | | | | | | |
| | 175° C. 1 hr | | | applied | applied | | | | | | |
| | 190° C. 1 hr | | | | | | applied | | | | |
| | 210° C. 1 hr | | | | | | | | | | |
| Surface treatment condition | Ultraviolet irradiation Integrated amount of light: 9000 mJ/cm2 | applied | applied | applied | applied | applied | applied | applied | applied | applied | applied |
| | Ultraviolet irradiation Integrated amount of light: 3000 mJ/cm2 | | | | | | | | | | |
| Suface treatment condition | Grinding treatment | | | | | | | | | | |

TABLE 3

| | | Example | | | | Comparative Example | | | | | |
|---|---|---|---|---|---|---|---|---|---|---|---|
| | | 21 | 22 | 23 | 24 | 1 | 2 | 3 | 4 | 5 | 6 |
| Amount added [parts by mass] | NBR ("JSR N230SL", JSR Corp.) | 100 | 100 | 100 | 100 | 100 | 100 | 100 | | 100 | 100 |
| | NBR ("JSR N215SL", JSR Corp.) | | | | | | | | | | |
| | SBR ("JSR SL552", JSR Corp.) | | | | | | | | | | |
| | BR ("JSR BR51", JSR Corp.) | | | | | | | | | | |
| | Epichlorohydrin rubber ("Epion 301", Osaka Soda Co., Ltd.) | | | | | | | | 100 | | |
| | Carbon black | 50 | 50 | 50 | 50 | 50 | 50 | 50 | 50 | 50 | 50 |
| | Zinc oxide | 5 | 5 | 5 | 5 | 5 | 5 | 5 | 5 | 5 | 5 |
| | Zinc stearate | 1 | 1 | 1 | 1 | 1 | 1 | 1 | 1 | 1 | 1 |
| | Calcium carbonate | 30 | 30 | 30 | 30 | 30 | 30 | 30 | 30 | 30 | 30 |
| | Sulfur | 1 | 1 | 1 | 1 | 3 | 0.2 | 1 | 1 | 1 | 1 |
| | "Nocceler TBzTD" | 4 | 4 | 4 | 4 | 5 | 3 | 4 | 4 | 4 | 4 |
| | Capsule particle 1 | | | | | | 5 | | 5 | 5 | 5 |
| | Capsule particle 2 | | | | | | | | | | |
| | Capsule particle 3 | | | | | | | | | | |
| | Capsule particle 4 | | | | | 5 | | | | | |
| | Capsule particle 5 | | | | | | | | | | |
| | Capsule particle 6 | | | | | | | | | | |
| | Capsule particle 7 | | | | | | | | | | |
| | PMMA particle ("GANZPEARL GM0801", Aica Kogyo Co., Ltd.) | | | | | | | | | | |
| | PMMA particle ("GANZPEARL GM3001", Aica Kogyo Co., Ltd.) | 30 | | | | | | | | | |
| | Polyethylene particle ("MIPELON PM200, Mitsui Chemicals, Inc.) | | 30 | | | | | | | | |
| | Polyurethane particle ("Dynamic Beads UCN-8150CM", Dainichiseika Color & Chemicals Mfg. Co., Ltd.) | | | | 30 | | | | | | |
| | Carbon particle ("Glassy Carbon", Tokai Carbon Co., Ltd.) | | | 30 | | | | | | | |
| Extrusion molding condition | Take-up rate: 107% | applied | applied | applied | applied | applied | applied | applied | applied | applied | applied |
| | Take-up rate: 101% | | | | | | | | | | |
| | Take-up rate: 94% | | | | | | | | | | |
| Vulcanization temperature condition | 160° C. 1 hr | applied | applied | applied | applied | | | applied | applied | applied | applied |
| | 145° C. 1 hr | | | | | | applied | | | | |
| | 175° C. 1 hr | | | | | | | | | | |
| | 190° C. 1 hr | | | | | | | | | | |
| | 210° C. 1 hr | | | | | applied | | | | | |

TABLE 3-continued

| | | Example | | | | Comparative Example | | | | | |
|---|---|---|---|---|---|---|---|---|---|---|---|
| | | 21 | 22 | 23 | 24 | 1 | 2 | 3 | 4 | 5 | 6 |
| Surface treatment condition | Ultraviolet irradiation Integrated amount of light: 9000 mJ/cm2 | applied | applied | applied | applied | applied | applied | applied | applied | | applied |
| | Ultraviolet irradiation Integrated amount of light: 3000 mJ/cm2 | | | | | | | | | | |
| | Grinding treatment | | | | | | | | | | applied |

TABLE 4

| | | Example | | | | |
|---|---|---|---|---|---|---|
| | | 1 | 2 | 3 | 4 | 5 |
| Evaluation of surface layer | Evaluation of surface layer | Insulating | Insulating | Insulating | Insulating | Insulating |
| | Martens' hardness [N/mm2] Core surface | 8.2 | 20.0 | 2.0 | 7.5 | 20.0 |
| | Martens' hardness [N/mm2] Convex part | 4.3 | 8.1 | 1.4 | 3.8 | 8.5 |
| | Viscosity [$\times 10^{-3}$ V] | 61.2 | 59.9 | 62.3 | 70.0 | 70.0 |
| | Spk [μm] | 7.1 | 5.8 | 7.8 | 7.5 | 7.4 |
| | Svk [μm] | 2.7 | 2.5 | 3.1 | 3.1 | 3.0 |
| | Sk [μm] | 10.1 | 9.5 | 10.8 | 8.2 | 9.7 |
| | Roughening | Present | Present | Present | Present | Present |
| | Particle exposure on surface layer | Present | Present | Present | Present | Present |
| | Particle size by roller cross section observation [μm] | 24 | 19 | 24 | 24 | 24 |
| | Balloon shape | Present | Present | Present | Present | Present |
| Image evaluation | 1 Evaluation of image density difference by durability test | A | C | C | C | C |
| | 2 Potential variation value by durability test [V] | 5.7 | 9.8 | 9.9 | 9.7 | 10.4 |
| | 3 Evaluation of image uniformity at non-central part | A | A | A | A | A |

| | | Example | | | | |
|---|---|---|---|---|---|---|
| | | 6 | 7 | 8 | 9 | 10 |
| Evaluation of surface layer | Evaluation of surface layer | Insulating | Insulating | Insulating | Insulating | Insulating |
| | Martens' hardness [N/mm2] Core surface | 2.0 | 9.1 | 6.9 | 7.5 | 5.6 |
| | Martens' hardness [N/mm2] Convex part | 1.5 | 4.9 | 3.5 | 4.0 | 3.8 |
| | Viscosity [$\times 10^{-3}$ V] | 70.0 | 67.9 | 61.7 | 57.0 | 62.5 |
| | Spk [μm] | 7.8 | 7.9 | 8.3 | 7.6 | 10.0 |
| | Svk [μm] | 3.3 | 2.9 | 3.4 | 2.4 | 4.3 |
| | Sk [μm] | 11.5 | 10.8 | 12.1 | 9.5 | 13.5 |
| | Roughening | Present | Present | Present | Present | Present |
| | Particle exposure on surface layer | Present | Present | Present | Present | Present |
| | Particle size by roller cross section observation [μm] | 24 | 24 | 24 | 24 | 30 |
| | Balloon shape | Present | Present | Present | Present | Present |
| Image evaluation | 1 Evaluation of image density difference by durability test | C | B | A | A | A |
| | 2 Potential variation value by durability test [V] | 10.3 | 7.9 | 6.1 | 5.1 | 5.5 |
| | 3 Evaluation of image uniformity at non-central part | A | A | A | A | B |

TABLE 5

| | | Example | | | | |
|---|---|---|---|---|---|---|
| | | 11 | 12 | 13 | 14 | 15 |
| Evaluation of surface layer | Evaluation of surface layer | Insulating | Insulating | Insulating | Insulating | Insulating |
| | Martens' hardness [N/mm2] Core surface | 5.5 | 6.1 | 8.9 | 5.9 | 8.1 |
| | Martens' hardness [N/mm2] Convex part | 4.1 | 3.5 | 5.3 | 4.2 | 5.4 |
| | Viscosity [$\times 10^{-3}$ V] | 62.3 | 63.2 | 59.5 | 61.3 | 59.9 |

TABLE 5-continued

| | | | | | | |
|---|---|---|---|---|---|---|
| | Spk [μm] | 3.0 | 12.8 | 2.3 | 6.5 | 10.0 |
| | Svk [μm] | 2.5 | 4.5 | 1.5 | 3.8 | 4.2 |
| | Sk [μm] | 5.9 | 9.6 | 5.0 | 18.1 | 15.0 |
| | Roughening | Present | Present | Present | Present | Present |
| | Particle exposure on surface layer | Present | Present | Present | Present | Present |
| | Particle size by roller cross section observation [μm] | 12 | 36 | 10 | 24 | 30 |
| | Balloon shape | Present | Present | Present | Present | Present |
| Image evaluation | 1 Evaluation of image density difference by durability test | B | A | C | C | A |
| | 2 Potential variation value by durability test [V] | 7.4 | 5.3 | 9.4 | 9.2 | 6.5 |
| | 3 Evaluation of image uniformity at non-central part | A | C | A | C | B |

| | | Example | | | | |
|---|---|---|---|---|---|---|
| | | 16 | 17 | 18 | 19 | 20 |
| Evaluation of surface layer | Evaluation of surface layer | Insulating | Insulating | Insulating | Insulating | Insulating |
| | Martens' hardness [N/mm2] Core surface | 9.6 | 8.0 | 7.6 | 7.7 | 8.0 |
| | Martens' hardness [N/mm2] Convex part | 5.8 | 4.3 | 4.8 | 4.1 | 10.0 |
| | Viscosity [$\times 10^{-3}$ V] | 59.1 | 61.3 | 61.4 | 60.8 | 61.0 |
| | Spk [μm] | 3.0 | 5.1 | 4.2 | 4.1 | 3.0 |
| | Svk [μm] | 4.2 | 6.0 | 8.0 | 6.0 | 1.5 |
| | Sk [μm] | 15.0 | 11.1 | 13.5 | 17.2 | 7.2 |
| | Roughening | Present | Present | Present | Present | Present |
| | Particle exposure on surface layer | Present | Present | Present | Present | Present |
| | Particle size by roller cross section observation [μm] | 13 | 24 | 24 | 24 | 8 |
| | Balloon shape | Present | Present | Present | Present | Absent |
| Image evaluation | 1 Evaluation of image density difference by durability test | B | B | C | C | B |
| | 2 Potential variation value by durability test [V] | 7.9 | 7.9 | 9.3 | 9.4 | 8.7 |
| | 3 Evaluation of image uniformity at non-central part | B | B | C | C | A |

TABLE 6

| | | | Example | | | | Comparative Example |
|---|---|---|---|---|---|---|---|
| | | | 21 | 22 | 23 | 24 | 1 |
| Evaluation of surface layer | Evaluation of surface layer | | Insulating | Insulating | Electroconductive | Insulating | Insulating |
| | Martens' hardness [N/mm2] | Core surface | 8.0 | 8.0 | 8.0 | 8.0 | 25.3 |
| | | Convex part | 10.0 | 10.0 | 10.0 | 5.0 | 18.9 |
| | Viscosity [$\times 10^{-3}$ V] | | 61.0 | 61.0 | 61.0 | 61.0 | 58.6 |
| | Spk [μm] | | 7.2 | 3.0 | 3.0 | 3.0 | 5.1 |
| | Svk [μm] | | 3.0 | 1.5 | 1.5 | 1.5 | 2.3 |
| | Sk [μm] | | 8.1 | 6.9 | 6.8 | 5.4 | 9.6 |
| | Roughening | | Present | Present | Present | Present | Present |
| | Particle exposure on surface layer | | Present | Present | Present | Present | Present |
| | Particle size by roller cross section observation [μm] | | 30 | 9 | 8 | 8 | 24 |
| | Balloon shape | | Absent | Absent | Absent | Absent | Present |
| Image evaluation | 1 Evaluation of image density difference by durability test | | B | B | C | B | D |
| | 2 Potential variation value by durability test [V] | | 8.6 | 8.9 | 9.5 | 8.6 | 12.8 |
| | 3 Evaluation of image uniformity at non-central part | | A | A | A | A | A |

| | | | Comparative Example | | | | |
|---|---|---|---|---|---|---|---|
| | | | 2 | 3 | 4 | 5 | 6 |
| Evaluation of surface layer | Evaluation of surface layer | | Insulating | — | Insulating | Insulating | Insulating |
| | Martens' hardness [N/mm2] | Core surface | 1.6 | 6.0 | 4.1 | 6.2 | 6.1 |
| | | Convex part | 1.4 | 6.0 | 2.9 | 4.3 | 3.9 |
| | Viscosity [$\times 10^{-3}$ V] | | 63.9 | 59.4 | 76.8 | 78.5 | 73.7 |
| | Spk [μm] | | 8.3 | 0.6 | 8.5 | 7.1 | 7.9 |

TABLE 6-continued

| | | | | | | |
|---|---|---|---|---|---|---|
| | Svk [μm] | 3.4 | 0.8 | 3.1 | 2.8 | 7.5 |
| | Sk [μm] | 11.1 | 1.1 | 9.2 | 10.3 | 8.2 |
| | Roughening | Present | Absent | Present | Present | Present |
| | Particle exposure on surface layer | Present | — | Present | Present | Present |
| | Particle size by roller cross section observation [μm] | 24 | — | 24 | 24 | 24 |
| | Balloon shape | Present | Absent | Present | Present | Absent |
| Image evaluation | 1 Evaluation of image density difference by durability test | D | D | D | D | D |
| | 2 Potential variation value by durability test [V] | 12.6 | 13.5 | 13.4 | 13.1 | 12.9 |
| | 3 Evaluation of image uniformity at non-central part | A | A | A | A | A |

From Tables 4 to 6, the charging members of Examples 1 to 24 according to the present invention exhibited a potential variation value of 12 V or less between the toner adhesion part and the non-adhesion part, ranks A to C in the evaluation of the image density difference between the central part and the non-central part, and ranks A to C in the evaluation of image density unevenness at the non-central part. Examples 1 to 24 tended to have an intermediate value in the specified range of the Martens' hardness of the core surface, small viscosity, smaller Martens' hardness of the convex part than that of the core surface, large Spk, small Svk, small Sk, and a good potential variation value and image density difference between the central part and the non-central part by use of an insulating balloon-shaped particle. However, too large Spk tended to facilitate the occurrence of image density unevenness at the non-central part.

On the other hand, in Comparative Example 1, the Martens' hardness of the core surface was larger than 20 N/mm$^2$. Therefore, the potential variation value between the central part and the non-central part was 12.8 V, and the image density difference between the central part and the non-central part was evaluated as rank D. In Comparative Example 2, the Martens' hardness of the core surface was smaller than 2 N/mm$^2$. Therefore, the potential variation value between the central part and the non-central part was 12.6 V, and the image density difference between the central part and the non-central part was evaluated as rank D. In Comparative Example 3, the surface was not roughened. Therefore, the potential variation value between the central part and the non-central part was 13.5 V, and the image density difference between the central part and the non-central part was evaluated as rank D. In Comparative Examples 4 to 6, the viscosity was larger than $70\times10^{-3}$ V. Therefore, the potential variation values between the central part and the non-central part were 13.4 V, 13.1 V and 12.9 V, respectively, and the image density difference between the central part and the non-central part was evaluated as rank D.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-199272, filed Oct. 7, 2016, which is hereby incorporated by reference herein in its entirety.

What is claimed is:

1. A method for producing a charging roller comprising an electroconductive support and an electroconductive elastic layer as a surface layer whose outer surface is roughened with insulating particles, the insulating particles being exposed to the outer surface, the method comprising:

(a) preparing an unvulcanized rubber composition comprising a polymer having a butadiene skeleton and insulating particles;

(b) supplying the electroconductive support and the unvulcanized rubber composition to a crosshead extrusion molding machine provided with a die having an inner diameter of "D", and molding an unvulcanized rubber roller having a layer of the unvulcanized rubber composition on the periphery of the electroconductive support, wherein a percentage value of (d−d0)/(D−d0) exceeds 100% where "d" is an outer diameter of the unvulcanized rubber roller and "$d_0$" is an outer diameter of the electroconductive support;

(c) vulcanizing the layer of the unvulcanized rubber composition in air, and obtaining a layer of a vulcanized rubber composition having an oxidatively cured topmost surface; and (d) ultraviolet irradiating said oxidatively cured topmost surface of the layer of the vulcanized rubber composition.

2. The method according to claim 1, wherein said polymer having a butadiene skeleton is at least one polymer selected from the group consisting of butadiene rubber, isoprene rubber, chloroprene rubber, acrylonitrile-butadiene rubber, styrene-butadiene rubber, and styrene-butadiene-styrene rubber.

* * * * *